US005881667A

United States Patent [19]

Herbert

[11] Patent Number: 5,881,667

[45] Date of Patent: Mar. 16, 1999

[54] ANTENNA BALL IDENTIFICATION SYSTEM

[76] Inventor: Jeffrey J. Herbert, 2752 N. Craig Cr., Fullerton, Calif. 92835

[21] Appl. No.: 833,910

[22] Filed: Apr. 10, 1997

[51] Int. Cl.[6] ..... G09F 21/04

[52] U.S. Cl. ..... 116/209; 116/28 R; 40/591

[58] Field of Search ..... 40/591; 116/209, 116/28 R

[56] References Cited

U.S. PATENT DOCUMENTS

| | | | |
|---|---|---|---|
| 2,329,046 | 9/1943 | Halbig | 116/28 R |
| 3,433,203 | 3/1969 | Sharkey et al. | 116/28 R |
| 3,531,634 | 9/1970 | Plouch | 116/28 R |
| 3,712,263 | 1/1973 | Faragosa | 116/28 R |
| 3,926,141 | 12/1975 | Taylor | 116/209 |
| 4,526,820 | 7/1985 | Haas | 428/31 |
| 5,078,075 | 1/1992 | Liming et al. | 116/173 |
| 5,176,099 | 1/1993 | Katz et al. | 116/209 |
| 5,572,225 | 11/1996 | McCarthy | 116/28 R |

*Primary Examiner*—Elizabeth L. Dougherty
*Assistant Examiner*—Willie Morris Worth

[57] ABSTRACT

An antenna ball identification system comprising first and second outer shells, with each shell having a hollow interior and a substantially planar perimeter edge. Each shell has an interior protrusion disposed inwardly from the perimeter edge which is structured to have a substantially hour glass shaped cavity, with each cavity extending out into the outer perimeter edge. The first shell is hingedly attached to the second shell such that the respective perimeter edges abut each other to form a structure having a substantially solid outer surface. The interior protrusions are positioned such that the cavities are positioned next to each other when the first and second shells are closed, with the cavities forming a hollow receptacle having a neck and extending inwardly from an opening formed by the cavities in the exterior of the structure. The receptacle receives a portion of the antenna rod such that the neck is positioned between the bulbous end of the antenna and the opening such that the structure is engaged to the antenna. A connection structure engages the first shell to the second shell such that the shells are held in a closed position, with the connection structure being integral to the outer shells.

8 Claims, 3 Drawing Sheets

10

20
22
24
12

10

25
46
48
30
34
24
20
6
28
6
22
30
14
34
42
44
40
23
12

ANTENNA BALL IDENTIFICATION SYSTEM

BACKGROUND OF THE INVENTION

1. Field of the Invention

The present invention relates to Antenna Devices and more particularly pertains to a new Antenna Ball Identification System for facilitating identification of a particular vehicle within a parking lot by attaching an aerodynamic structure to an antenna rod which includes an indicia to identify the vehicle or to advertise a company.

2. Description of the Prior Art

The use of Antenna Devices is known in the prior art. More specifically, Antenna Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Antenna Devices include U.S. Pat. No. 4,978,964; U.S. Pat. No. 4,972,795; U.S. Pat. No. 5,176,099; U.S. Pat. No. 4,905,624; U.S. Pat. No. 4,110,818 and U.S. Pat. No. 5,016,372.

While these devices fulfill their respective, particular objectives and requirements, the aforementioned patents do not disclose a new Antenna Ball Identification System. The inventive device includes an encasement structure split into semi-portions, a capturing means secured interiorly of the encasement structure which receives an antenna, a male and female attaching means removably securing the two semi-portions, and at least one indicia for identifying the vehicle or for advertising a particular company.

In these respects, the Antenna Ball Identification System according to the present invention substantially departs from the conventional concepts and designs of the prior art, and in so doing provides an apparatus primarily developed for the purpose of facilitating identification of a particular vehicle within a parking lot by attaching an aerodynamic structure to an antenna rod which includes an indicia to identify the vehicle or to advertise a company.

SUMMARY OF THE INVENTION

In view of the foregoing disadvantages inherent in the known types of Antenna Devices now present in the prior art, the present invention provides a new Antenna Ball Identification System construction wherein the same can be utilized for facilitating identification of a particular vehicle within a parking lot by attaching an aerodynamic structure to an antenna rod which includes an indicia to identify the vehicle or to advertise a company.

The general purpose of the present invention, which will be described subsequently in greater detail, is to provide a new Antenna Ball Identification System apparatus and method which has many of the advantages of the Antenna Devices mentioned heretofore and many novel features that result in a new Antenna Ball Identification System which is not anticipated, rendered obvious, suggested, or even implied by any of the prior art Antenna Devices, either alone or in any combination thereof.

To attain this, the present invention generally comprises an encasement structure split into semi-portions, a capturing means secured interiorly of the encasement structure which receives an antenna, a male and female attaching means removably securing the two semi-portions, and at least one indicia for identifying the vehicle or for advertising a particular company.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Antenna Ball Identification System apparatus and method which has many of the advantages of the Antenna Devices mentioned heretofore and many novel features that result in a new Antenna Ball Identification System which is not anticipated, rendered obvious, suggested, or even implied by any of the prior art Antenna Devices, either alone or in any combination thereof.

It is another object of the present invention to provide a new Antenna Ball Identification System which may be easily and efficiently manufactured and marketed.

It is a further object of the present invention to provide a new Antenna Ball Identification System which is of a durable and reliable construction.

An even further object of the present invention is to provide a new Antenna Ball Identification System which is susceptible of a low cost of manufacture with regard to both materials and labor, and which accordingly is then susceptible of low prices of sale to the consuming public, thereby making such Antenna Ball Identification System economically available to the buying public.

Still yet another object of the present invention is to provide a new Antenna Ball Identification System which provides in the apparatuses and methods of the prior art some of the advantages thereof, while simultaneously overcoming some of the disadvantages normally associated therewith.

Still another object of the present invention is to provide a new Antenna Ball Identification System for facilitating identification of a particular vehicle within a parking lot by attaching an aerodynamic structure to an antenna rod which includes an indicia to identify the vehicle or to advertise a company.

Yet another object of the present invention is to provide a new Antenna Ball Identification System which includes an encasement structure split into semi-portions, a capturing means secured interiorly of the encasement structure which receives an antenna, a male and female attaching means removably securing the two semi-portions, and at least one indicia for identifying the vehicle or for advertising a particular company.

Still yet another object of the present invention is to provide a new Antenna Ball Identification System that identifies a particular vehicle's ownership or for advertising.

Even still another object of the present invention is to provide a new Antenna Ball Identification System that is shaped to the form of various objects such as a football, basketball, golf ball, spherical, cylindrical, or rectangular shaped.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof Such description makes reference to the annexed drawings wherein.

DESCRIPTION OF THE PREFERRED EMBODIMENT

Figure 1:
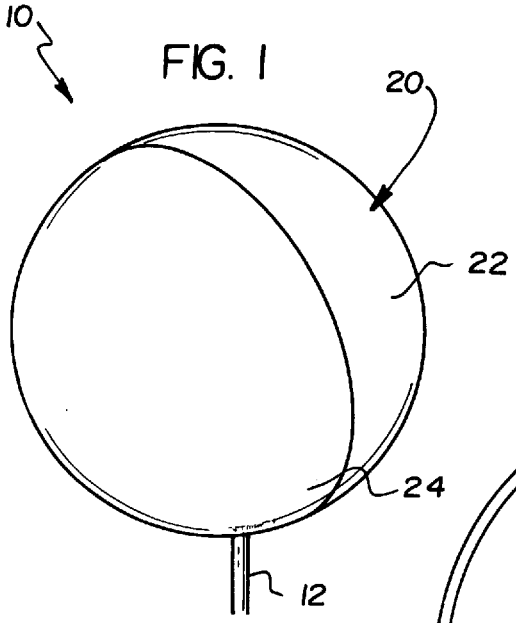
FIG. 1 is a side perspective view of a new Antenna Ball Identification System according to the present invention.
Figure 2:
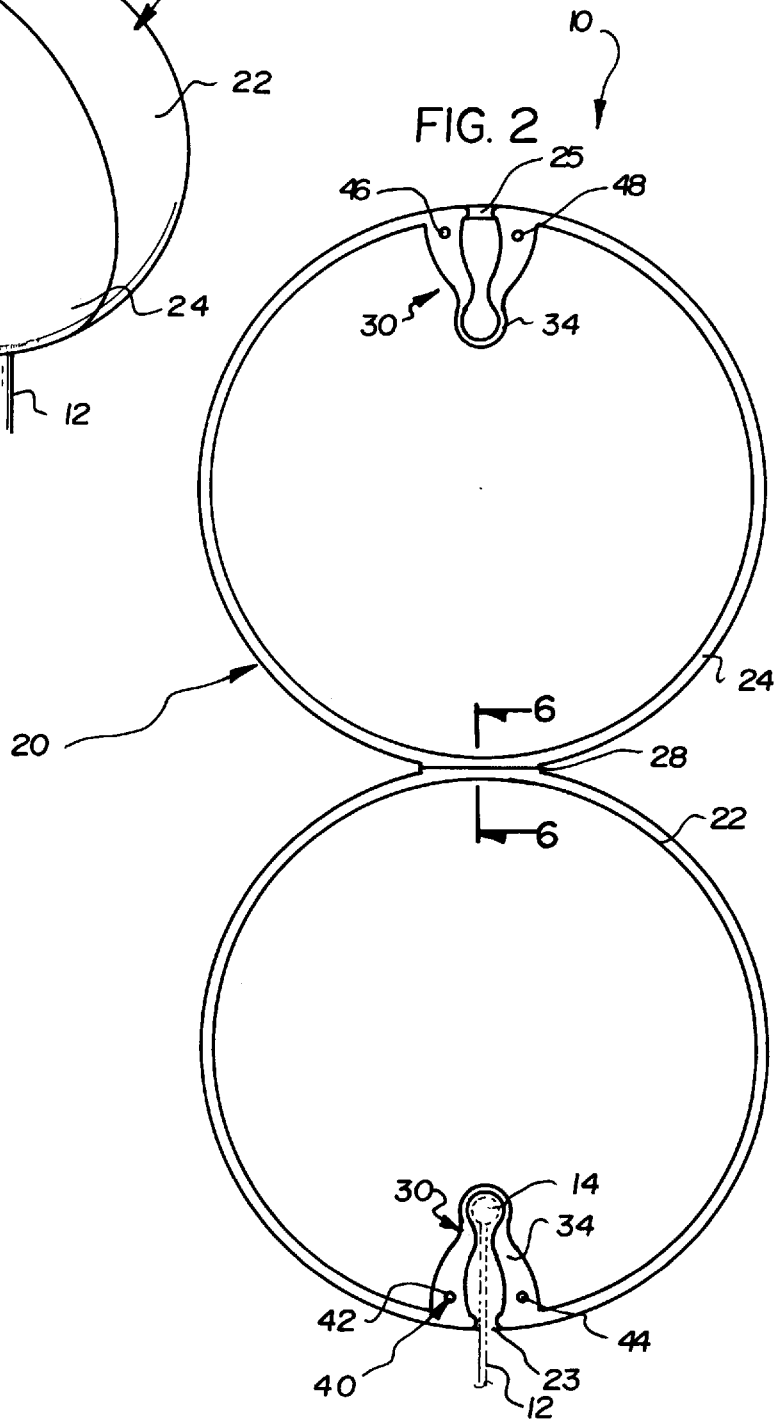
FIG. 2 is an internal view of the two semi-portions of the encasement structure disclosing the capturing means.
Figure 3:
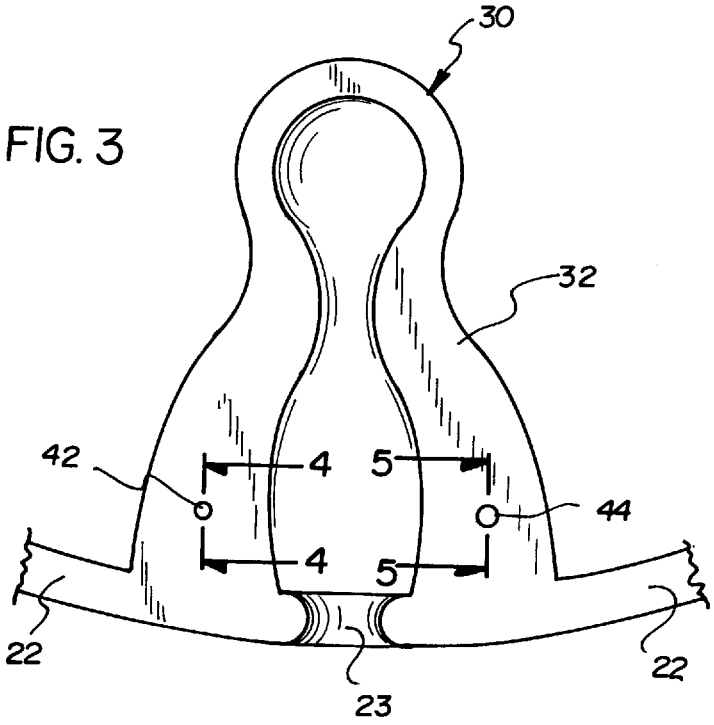
FIG. 3 is a magnified view of the first semi-boule member.
Figure 4:
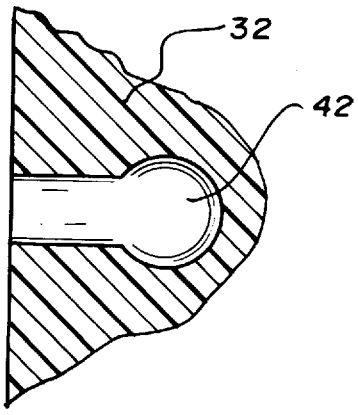
FIG. 4 is a cross sectional view taken along line 4—4 of FIG. 3 disclosing the first female connector.
Figure 5:
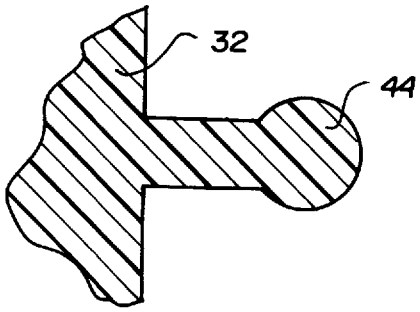
FIG. 5 is a cross sectional view taken along line 5—5 of FIG. 3 disclosing the first male connector.
Figure 6:
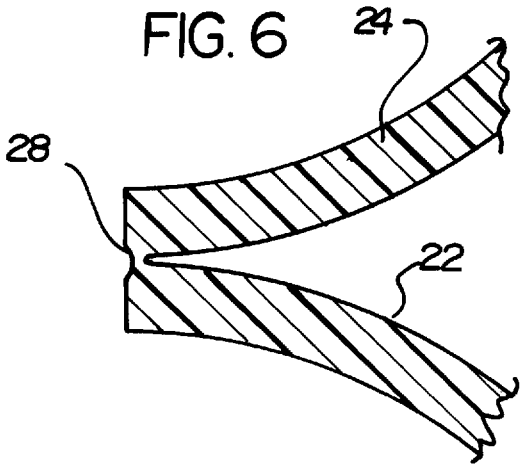
FIG. 6 is a cross sectional view taken along line 6—6 of FIG. 2 showing the living hinge.

With reference now to the drawings, and in particular to FIGS. 1 through 7 thereof, a new Antenna Ball Identification System embodying the principles and concepts of the present invention and generally designated by the reference numeral 10 will be described.

More specifically, it will be noted that the Antenna Ball Identification System 10 comprises an encasement structure 20 including a first half cover 22 and a second half cover 24 pivotally attached by a living hinge 28 where said covers form a hollow shape when juxtaposed, a capturing means 30 within the encasement structure 20 which captures an antenna rod 12 and a spherical end 14 of the antenna rod 12, and the encasement structure 20 including a male and female attaching means 40 opposite of the living hinge 28.

As best illustrated in FIGS. 1 through 7, it can be shown that the first half cover 22 includes a first aperture 23 opposite of the living hinge 28. A first semi-boule member 32 is secured within the first half cover 22 connected to the first aperture 23 as best disclosed in FIG. 3 of the drawings. The second half cover 24 includes a second aperture 25 opposite of the living hinge 28. A second semi-boule member 34 is secured within the second half cover 24 connected to the second aperture 25. When the first half cover 22 and the second half cover 24 are closed the semi-boule members form a full semi-boule member which captures the spherical end 14 of the antenna rod 12. The first half cover 22 includes a first female connector 42 opposite of the living hinge 28 and includes a first male connector 44 opposite of the living hinge 28 as best disclosed in FIGS. 3–5 of the drawings. The second half cover 24 includes a second female connector 48 opposite of the living hinge 28 which receives the first male connector 44 and includes a second male connector 46 opposite of the living hinge 28 which projects into the first female connector 42. The encasement structure 20 is preferably constructed from a rigid plastic formed in various shapes such as a football, a golf ball, a basketball, cylindrical shape, or a rectangular shape.

In use, the user separates the first and second half covers 22 and 24. The user then places the present invention over the antenna rod 12 and the spherical end 14. The user then closes the first and second half covers 22 and 24 utilizing the male and female attaching means 40 to lock the present invention over the antenna rod 12. The spherical end 14 is captured by the semi-boule formed from the first and second semi-boule members 32 and 34 being juxtaposed. Indicia may be printed upon an outer surface of the encasement structure 20 for indicating the individual's vehicle or for advertising a particular business.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An antenna ball identification system for attachment to an antenna, the antenna having a substantially slender rod and a bulbous end, the antenna ball identification system comprising:

a first and a second outer shell, each shell having a hollow interior, each shell further having a substantially planar perimeter edge;

each shell having a respective interior protrusion disposed inwardly from said respective perimeter edges of each shell, each protrusion structured to have a substantially hour glass shaped cavity, each said cavity extending out into each respective outer perimeter edge;

said first shell being hingedly attached to said second shell such that said respective perimeter edges abut each other to form a structure having a substantially solid outer surface when said first and second shells are in a closed position;

said interior protrusions further being positioned such that said cavities are positioned next to each other when said first and second shells are closed, said cavities forming a hollow receptacle having a neck, the receptacle extending inwardly from an opening formed by said cavities in the exterior of said structure, said receptacle being for receiving a portion of the antenna rod such that the neck is positioned between the bulbous end of the antenna and the opening such that the structure is engaged to the antenna; and a connection means for engaging said first shell to said second shell such that said shells are held in a closed position, said connection means being integral to said outer shells.

2. The antenna ball identification system of claim 1, wherein said outer shells are each substantially semi-spherical shaped.

3. The antenna ball identification system of claim 1, further comprising indicia positioned on said exterior surface of said structure.

4. The antenna ball identification system of claim 1 wherein said structure is shaped to resemble one of the balls chosen from the group of balls consisting of a football, a basketball, and a golf ball.

5. The antenna ball identification system of claim 1 wherein said connection means includes one of a pair of male connectors and a pair of female connectors being positioned on the interior protrusion of the first shell and the other of the pair of male connectors and the female connectors being positioned on the interior protrusion of the second shell such that said pair of male connectors is engaged to said pair of female connectors when said first shell and said second shell are in a closed position.

6. The antenna ball identification system of claim 1, said receptacle further comprising:

upper and lower chambers separated by said neck, said upper and lower chambers having a larger size than said neck.

7. The antenna ball identification system of claim 1, wherein a hinge is located opposite the opening in the exterior of said structure to position said hinge at an upper location on said structure when said structure is mounted on an antenna.

8. An antenna ball identification system for attachment to an antenna, the antenna having a substantially slender rod and a bulbous end, the antenna ball identification system comprising:

a first and a second outer shell, each shell having a hollow interior, each shell further having a substantially planar outer perimeter edge;

each shell having a respective interior protrusion disposed inwardly from said respective perimeter edges of each shell, each protrusion structured to have a substantially hour glass shaped cavity, each said cavity extending out into each respective outer perimeter edge;

said first shell being hingedly attached to said second shell such that said respective perimeter edges abut each other to form a structure having a substantially solid outer surface when said first and second shells are in a closed position;

said interior protrusions further being positioned such that said cavities are positioned next to each other when said first and second shells are closed, said cavities forming a hollow receptacle having a neck, the receptacle extending inwardly from an opening in the exterior of said structure formed by said cavities, said receptacle being for receiving a portion of the antenna rod such that the neck is positioned between the bulbous end of the antenna and the opening such that the solid structure is engaged to the antenna;

a connection means for engaging said first shell to said second shell such that said shells are held in a closed position;

indicia positioned on said exterior surface of said structure;

wherein said structure is shaped to resemble one of the balls chosen from the group of balls consisting of a football, basketball, and a golf ball;

wherein said connection means includes one of a pair of male connectors and a pair of female connectors being positioned on the interior protrusion of the first shell and the other of the pair of male connectors and the female connectors being positioned on the interior protrusion of the second shell such that said pair of male connectors is engaged to said pair of female connectors when said first shell and said second shell are in a closed position.

* * * * *